US008136578B2

(12) United States Patent
Qvist

(10) Patent No.: US 8,136,578 B2
(45) Date of Patent: Mar. 20, 2012

(54) HEAT EXCHANGER FOR EGR-GAS

(75) Inventor: Hans-Gunnar Qvist, Göteborg (SE)

(73) Assignee: Volvo Lastvagnar AB, Göteborg (SE)

( * ) Notice: Subject to any disclaimer, the term of this patent is extended or adjusted under 35 U.S.C. 154(b) by 657 days.

(21) Appl. No.: 12/280,801

(22) PCT Filed: Mar. 13, 2006

(86) PCT No.: PCT/SE2006/000322

§ 371 (c)(1),
(2), (4) Date: Aug. 27, 2008

(87) PCT Pub. No.: WO2007/105992

PCT Pub. Date: Sep. 20, 2007

(65) Prior Publication Data

US 2009/0025915 A1 Jan. 29, 2009

(51) Int. Cl.
*F28D 1/04* (2006.01)
*B21D 53/06* (2006.01)

(52) U.S. Cl. ..... 165/81; 165/182; 165/151

(58) Field of Classification Search ..... 165/81, 165/151, 109.1, 179, 182; 29/890.049
See application file for complete search history.

(56) References Cited

U.S. PATENT DOCUMENTS 2,697,588 A * 12/1954 Jensen ..... 165/166
3,225,824 A * 12/1965 Wartenburg ..... 165/122
6,378,203 B1 4/2002 Lu et al.
7,571,759 B2 * 8/2009 Inagaki et al. ..... 165/80.4
2004/0144525 A1 * 7/2004 Chatel et al. ..... 165/166
2004/0149425 A1 8/2004 Abiko et al.
2005/0121179 A1 * 6/2005 Shibagaki et al. ..... 165/153
2006/0243429 A1 * 11/2006 Chu et al. ..... 165/109.1

FOREIGN PATENT DOCUMENTS

DE 20003919 U1 5/2000
EP 1544564 A1 6/2005
JP 2004150672 A 5/2004
JP 2007064606 A * 3/2007

OTHER PUBLICATIONS

Supplementary European Search Report for corresponding EP 06 71 7007.

International Search Report for corresponding International Application PCT/SE2006/000322.

* cited by examiner

*Primary Examiner* — Tho V Duong

(74) *Attorney, Agent, or Firm* — WRB-IP LLP

(57) ABSTRACT

A heat exchanger for a first and a second medium flow includes flat tubes which have internal fins formed from zig-zag-shaped sheet metal plate. The tubes have a thermally conductive connection to at least one duct for the one medium flow. Each fin is fixed only to the one longitudinal side of each tube. Furthermore, there is a gap between the fins fixed to the one longitudinal side and the opposite longitudinal side of the tube.

10 Claims, 3 Drawing Sheets

HEAT EXCHANGER FOR EGR-GAS

BACKGROUND AND SUMMARY

The present invention relates to a heat exchanger for a first and a second medium flow, comprising flat tubes which have internal tins formed from zigzag-shaped sheet metal plate, said tubes having a thermally conductive connection to at least one duct for the one medium flow.

Heat exchangers for EGR-gas are used, for example, in diesel engines for heavy vehicles and are exposed to very large temperature changes as the working temperature varies greatly from cold starting to full load. These temperature changes can give rise to problems in the form of fatigue and damage in the metal structure, which on the one hand can lead to impaired heat exchange and on the other can have a negative effect on the gas flow through the heat exchanger.

It is desirable to provide a heat exchanger for EGR-gas, which is more resistant to temperature changes and is thereby more reliable.

To this end, the heat exchanger according to the invention is characterized in that the fins are fixed only to the one longitudinal side of each tube, and that there is a gap between the fins fixed on the one longitudinal side and the opposite longitudinal side of the tube. Forming the tubes in this way means that as the fins heat up they have scope to expand into said gap, towards the opposite tube wall.

BRIEF DESCRIPTION OF THE DRAWINGS

The invention will be described in more detail below, with reference to exemplary embodiments shown in the drawings attached, in which.

DETAILED DESCRIPTION

Figure 1:
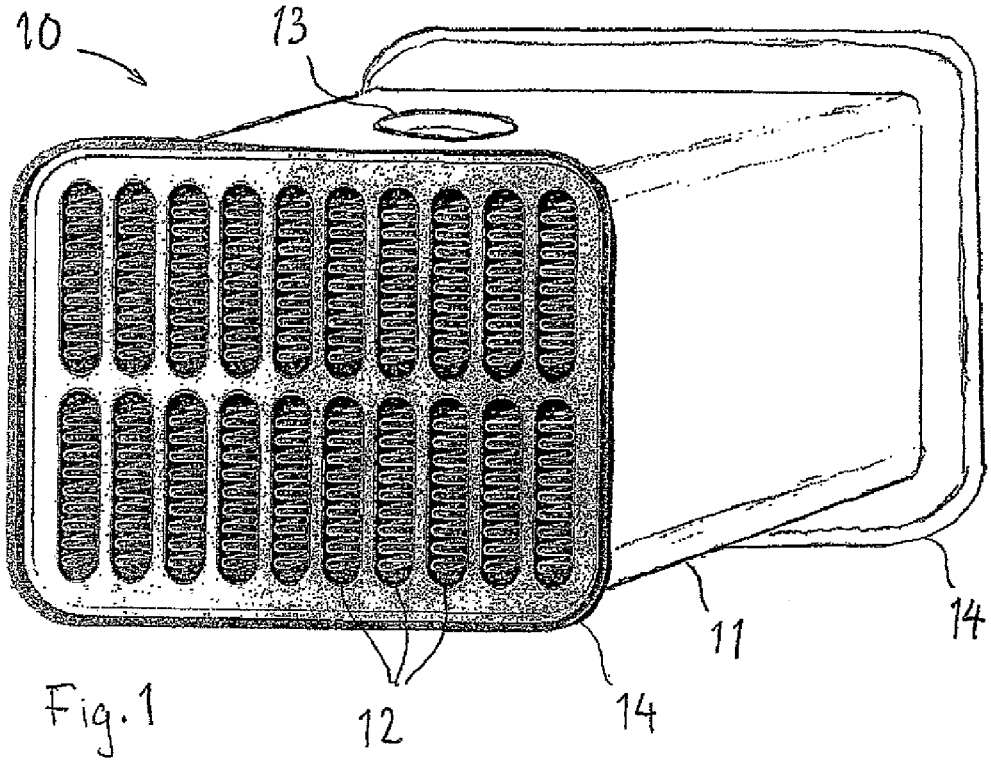
FIG. 1 is a perspective view of a heat exchanger according to a first exemplary embodiment of the invention.

The heat exchangers 10 shown in the drawings are intended for use as cooling radiators for EGR-gas in a diesel engine for a heavy vehicle. In a first exemplary embodiment according to FIG. 1 the heat exchanger comprises a duct casing 11, which encloses twenty gas tubes 12. The duct casing 11 is provided with an inlet 13 and an outlet (not shown) for a first medium flow, suitably coolant from the engine cooling system.

The gas tubes 12 take the form of flat tubes and via end pieces 14 are mounted parallel inside the duct casing 11 at a distance from one another and at a distance from the duct wall. The gas tubes 12 form part of a duct for carrying EGR-gas from the engine exhaust manifold to the engine inlet manifold.

Figure 2:
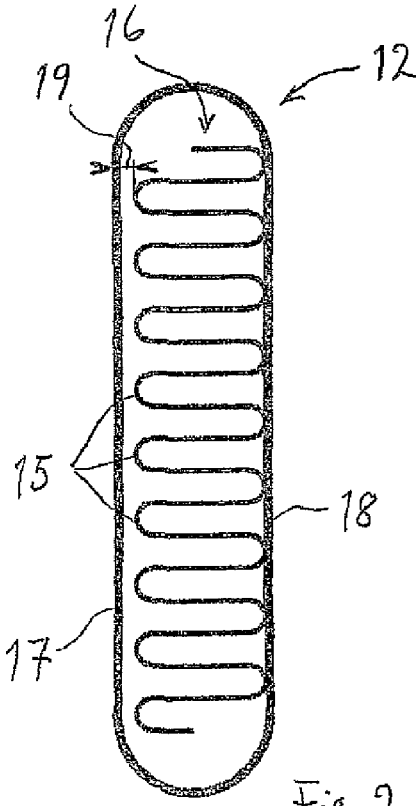
FIG. 2 is an end view of a gas tube forming part of the heat exchanger in FIG. 1, according to a first exemplary embodiment of the invention.
Figure 3:
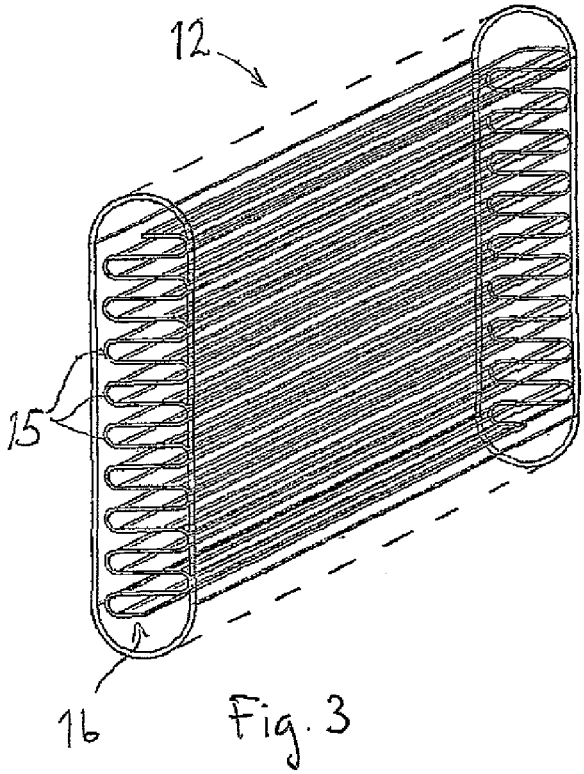
FIG. 3 shows a perspective view of the fins forming part of the gas tube in FIG. 2.

Each of the gas tubes 12 is provided with longitudinal, heat-transmitting fins 15, which in the exemplary embodiment according to FIGS. 2 and 3 are formed from a sheet metal plate 16 which is bent in a zigzag shape and which, after it has been inserted into the tube, has then been connected to one side 17 of the two longitudinal sides 17, 18 of the flattened tube conduit.

The fins 15 extend laterally in such away that there is a gap 19 between the fins fixed to the one longitudinal side 18 and the opposite longitudinal side 17 of the tube conduit 12. The gap 19 is greater than the thermal expansion to which the fins 15 may ordinarily be exposed. The fact that the fins are thus only fixed to the one longitudinal side and that there is also space, via the gap 19, to expand freely towards the opposite longitudinal side 17 of the tube conduit 12, means that the tube is able to withstand cyclical thermal expansion without the risk of harmful deformation.

Figure 4:
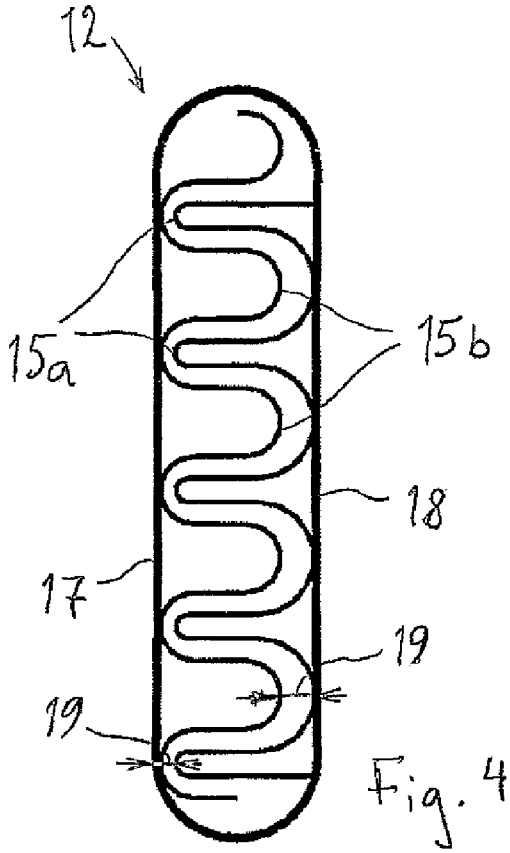
FIG. 4 is an end view of a gas tube forming part of the heat exchanger in FIG. 1, according to a second exemplary embodiment of the invention.
Figure 5:
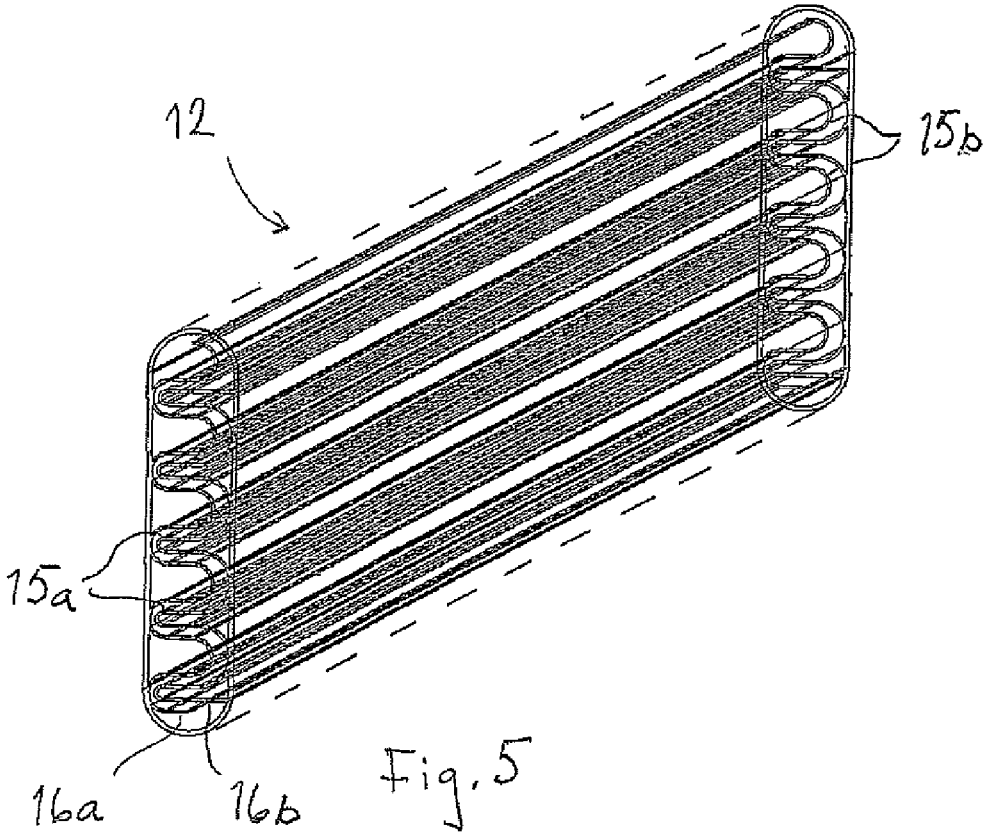
FIG. 5 shows a perspective view of the fins forming part of the gas tube in FIG. 4.

FIGS. 4 and 5 show a second exemplary embodiment of the heat exchanger according to FIG. 1, in which the gas tube 12 is provided with fins 15, which are formed from two separate fin plates 16*a*, 16*b*. Here the fin plates have been bent with a zigzag shape in different ways, so that they conform to one another without any risk of coming into contact with one another. According to this exemplary embodiment of the invention, the one fin plate 16*a* is connected to the longitudinal side 17, whilst the other fin plate 16*b* is connected to the opposite longitudinal side 18 and there are gaps 19 for thermal expansion to either side. The fact that both of the longitudinal sides 17, 18 are provided with fins 15 means that the heat transmission to both of the longitudinal sides will be more even than in the preceding exemplary embodiment according to FIGS. 1-3.

Figure 6:
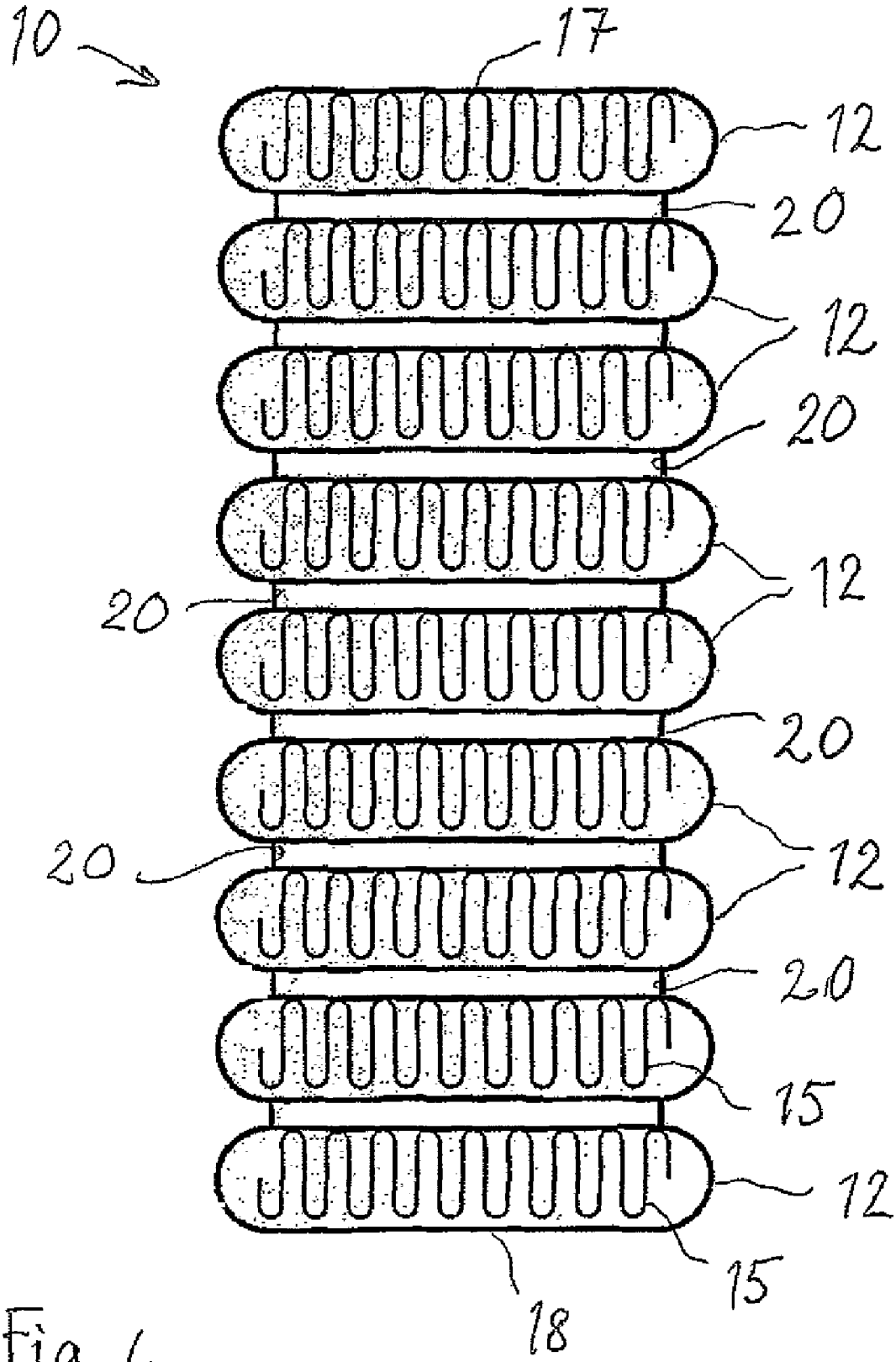
FIG. 6 is an end view of a heat exchanger according to a third exemplary embodiment of the invention.

FIG. 6 shows a further exemplary embodiment of the heat exchanger according to the invention, in which the casing is omitted and the first medium flow, suitably coolant from the engine cooling system, is led via an enclosed duct 20 arranged between each pair of tubes 12. This type of heat exchanger is usually referred to as a plate cooler.

The fins 15, 15*a*, 15*b* shown in the drawings are shown with an undulating shape, but may have any other desired shape. The plates forming the tube fins can be connected to the inside of the tube by brazing or welding.

The invention must not be regarded as being limited to the exemplary embodiments described above, a number of other variants and modifications being feasible without departing from the scope of the following patent claims.

The invention claimed is:

1. A heat exchanger for a first and a second medium flow, comprising flat tubes which have internal fins formed from zigzag-shaped sheet metal plate, the tubes having a thermally conductive connection to at least one duct for the first medium flow, wherein each fin is fixed only to one longitudinal side of each tube, and wherein there is a gap between the fins fixed to the one longitudinal side and an opposite longitudinal side of the tube, and at least one of the tubes is provided with fins on both of the longitudinal sides, wherein, in the at least one of the tubes, a first plate forms fins on and is fixed to only a first longitudinal side of the at least one of the tubes, and a second plate forms fins on and is fixed to only a second longitudinal side of the at least one of the tubes.

2. The heat exchanger as claimed in claim 1, wherein the gap is greater than a thermal expansion to which the fins may ordinarily be exposed.

3. The heat exchanger as claimed in claim 1, wherein the fins are of undulating shape.

4. The heat exchanger as claimed in claim 1, wherein the fins are fixed to an inside of the tube by brazing.

5. The heat exchanger as claimed in claim 1, wherein the first medium flow consists of coolant.

6. The heat exchanger as claimed in claim 1, wherein the second medium flow consists of EGR-gas.

7. The heat exchanger as claimed in claim 1, wherein the tubes are fitted inside a casing having an inlet and an outlet for the first medium flow.

8. The heat exchanger as claimed in claim 1 wherein at least one of the tubes is fitted between two ducts for carrying the first medium flow.

9. The heat exchanger as claimed in claim 1, wherein the first medium flow comprises coolant.

10. The heat exchanger as claimed in claim 1, wherein the second medium flow comprises EGR-gas.

* * * * *